United States Patent [19]

Massey

[11] Patent Number: 4,987,615

[45] Date of Patent: Jan. 29, 1991

[54] METHOD OF CONSTRUCTING HUMAN-LIKE COSTUME HEADS

[76] Inventor: Judy E. Massey, 7217 Twin Lakes La., Pensacola, Fla. 32514

[21] Appl. No.: 242,024

[22] Filed: Sep. 8, 1988

[51] Int. Cl.[5] ..... A42B 1/00

[52] U.S. Cl. ..... 2/206; 446/385; 264/45.5

[58] Field of Search ..... 2/69, 173, 206, 9; 434/81, 82; 446/268, 385, 369, 370, 372, 373, 374; 264/45.5, 45.6, 48

[56] References Cited

U.S. PATENT DOCUMENTS

| | | | |
|---|---|---|---|
| 3,541,192 | 11/1970 | Shapero | 264/45.5 |
| 3,852,389 | 12/1974 | Adler | 264/DIG. 5 |
| 4,175,411 | 11/1979 | Allen | 2/206 |
| 4,660,033 | 4/1987 | Brandt | 2/69 |

FOREIGN PATENT DOCUMENTS

| | | | |
|---|---|---|---|
| 2402316 | 3/1975 | Fed. Rep. of Germany | 446/385 |
| 583528 | 1/1925 | France | 446/385 |
| 2264650 | 10/1975 | France | 264/45.5 |
| 586373 | 3/1947 | United Kingdom | 2/206 |

*Primary Examiner*—Werner H. Schroeder
*Assistant Examiner*—Diana L. Biefeld
*Attorney, Agent, or Firm*—Pravel, Gambrell, Hewitt, Kimball & Krieger

[57] ABSTRACT

A method of constructing large human-like costume heads such as caricatures of famous people which includes the steps of sculpting a large block of foam into the rough form of a head to form a sculpted human-like head with a facial portion. The outer portion of the foam block is painted using a desired color scheme. A very thin layer of rubber-like material is applied to the foam block outer surface which seals the foam block but which is sufficiently thin to allow deflection of the foam when squeezed and to provide a texture to the foam that can be felt and which resembles a skin like feeling.

5 Claims, 2 Drawing Sheets

METHOD OF CONSTRUCTING HUMAN-LIKE COSTUME HEADS

BACKGROUND OF THE INVENTION

1. Field of the Invention

The present invention relates to costumes having enlarged caricature heads and/or bodies of foam construction wherein an improved construction provides a lightweight, lifelike and durable costume construction that resists breakage and deterioration.

2. General Background

Costumes are often used in an artistic form that enlarges the head and/or body so that facial and other features, for example, are exaggerated. These types of costumes are commonly used in connection with advertising, plays, shows, sports events and the like.

Advertising often involves the use of costumes which might for example include a caricature, a personification, or other artistic rendition associated with a particular company's product. Frequently, radio stations, television stations and other business organizations use costumes in association with particular promotional events, or with advertising campaigns.

College and professional sports organizations frequently have mascots which are artistic caricatures, or fanciful cartoon-like characters many of which have very disproportionate and/or enlarged heads and or bodies as compared to the human body size and proportions. Costumes often use such personification to transform a company's product (such as a soft drink can) into a life like animated character.

When manufacturing a costume having a very large head portion, it is difficult to make the head very large as compared to typical human head because of the difficulty in supporting the head because of weight and size. Further, when lightweight materials are used in the formation of caricature or costume heads, a problem exists in that the material, while necessarily lightweight, also can be very fragile having a tendency to break, tear, rip or become damaged.

One of the problems of costumes, caricature heads and or puppet heads which are very large is that they can quickly wear and deteriorate if subjected to substantial use. This is true of both paper mache and foam which are commonly used in costume construction.

Some foam is an absorbant cellular material which absorbs liquids such as paint upon contact. Thus it is often difficult to work with foam in the creation of caricature heads, costumes and the like wherein it is desirable to first form the foam into a particular shape and then prevent those shapes from breaking off. For example, appendages of a human's head such as the nose, lips and ears have a tendency to tear or fall off when they are made with a foam material. The use of paints or other material on the foam creates a weight problem. Foam can be absorbent and the foam can soak up anything applied to it rendering the foam saturated and overweight. The foam can fall apart because it has become too heavy if extensive paint/liquids are absorbed.

Several patents have issued which relate to various constructions of costumes, caricatures, dolls and the like.

Early examples of costume patents include U.S. Pat. No. 2,028,206 entitled "Disguise" issued on Jan. 21, 1936 to W. A. Hall; U.S. Pat. No. 2,089,376 entitled "Inanimate Figure and Method of Making Same" issued Aug. 10, 1937 to E. Jacobson; and U.S. Pat. No. 2,124,767 entitled "Disguise Medium" issued on July 26, 1938 to J. W. Dawn.

Various patented constructions of plastic bodies use molds, such as U.S. Pat. Nos. 3,541,192 and 3,852,389.

U.S. Pat. No. 3,541,192 entitled "Method of Producing Plastic Objects Having Smooth Skin Portions and Foamed Interior Portions" issued Nov. 17, 1970 to W. H. Shapero et al., providing a plastic base material having gas-releasing capability, is placed in a mold, which is subjected to a forced internal pressure change to control the timing of the release of the gas (to form the foamed interior portions of an object) while it is treated (as by heating a vinyl plastisol composition in the known rotocasting process) to form a smooth, soft skin and to complete formation of both the skin and interior portions.

U.S. Pat. No. 3,852,389 entitled "Method of Making Foam Plastic Bodies Having Lifelike Outer Skins" issued Dec. 3, 1974 to Adler et al., provides a method of making bodies of foamed plastic comprising filling a mold initially with a plastisol having a very small amount of blowing agent which will be activated, heating the mold to form a thin gelled layer of the plastisol covering the inner surface of the mold, then charging the mold with a second plastisol containing a significantly larger amount of blowing agent that will be activated; attaching the mold to a pressure release cap whereby the pressure in the mold can be controlled; then heating the mold at a temperature sufficient to release the blowing agents in the plastisol layers, while controllably releasing the gas from the mold through the pressure release cap. After cooling, the foamed body can then be removed from the mold.

U S. Pat. No. 4,451,933 entitled "Costume Mask Armature" issued June 5, 1984 to Seng et al., provides a universal costume mask armature is disclosed in which a rigid, preferably lattice, infrastructure including skull-shaped cranium and face portion is utilized. The face portion is preferably generally flattened and includes a pair of eye ports. A nose plate between the eye ports forms a continuation of the face and serves to receive and support nose features of a mask mounted on the armature. The face portion also includes a maxilary plate located below the nose plate to receive and support upper lip features of a mask. Use of this armature will enable a very wide range and variety of masks to be interchanged because the construction of the face portion of the armature is designed to support unlimited combinations of nose, eyebrows, beak etc. without regard to their weight or size.

U.S. Pat. No. 4,565,376 entitled "Animal Simulating Three Dimensional Archery Target and method of Manufacture" issued Jan. 21, 1986 to Croll provides and archery target wherein transversely gathered thermoplastic film is wrapped into the shape of an animal to be simulated, the wrapped shape is covered with thermoplastic sheeting heat sealed to the wrapped film, and the shape is filled with additional transversely gathered plastic film folded upon itself and inserted into the wrapped film shape.

U.S. Pat. No. 4,659,319 entitled "Image in Three Dimensions With Picture Covering and Forming System" issued Apr. 21, 1987 to Blair provides a three-dimensional image, which can be the face of a person, or other image having: a base, a picture module formed of flexible picture material bearing thereon a picture-making coating which latter is imprinted thereon in duplication from a photograph by known methods. the picture-module being attached to the forward side of the base and such forward side having a shape complementary to the picture coating as is accomplished by the method of this invention which is sculpting the material which makes the forward side of the base while such material is flexible and before heating it, the shaping of the moldable material being done by pressure exerted on and through the module as guided visually by the picture-making coating which latter can be accomplished by human sculpturing skill whereby the picture module is also sculpted into a new shape and complementary to the sculpted base.

The use of injection type molds to create a costume form over and over requires substantial initial expense which can only be justified if numerous costumes of the same configuration are desired. This does not solve the problem of creating custom costume masks, faces, bodies and the like where an inexpensive, workable system is desired to create lifelike and durable costume figures.

SUMMARY OF THE PRESENT INVENTION

The present invention solves the prior art problems and shortcomings by providing a simple yet workable method of constructing large human-like caricature heads, having a face portion with skin like texture, and/or bodies of foam like material. A block of foam, which can be, e.g., a cylinder, is firstly cut into a rough form approximately the final shape. The foam block is custom sculpted by hand at its outer surface to form a sculpted human-like head with a facial portion, preferably using a cutting instrument such as a knife. Sanding can be used to smooth any sharp edges formed by the knife. With a body-like costume, the outer surface of the sculpted foam block is then painted using a desired color scheme at least with respect to one or more of the facial features thereon for caricature heads. After painting the outer surface of the sculpted foam block with the desired color scheme, a very thin layer of rubber-like material is applied in liquid form to the foam block outer surface, which seals the foam, provides an outer protective coating for the foam, but yet which allows deflection of the foam when squeezed. The coatings are not overly thick and retain some of the texture of the foam so that the outer coating resembles a skin-like textured feeling.

Thus an apparatus is provided in the form of an enlarged life-like costume having a body of foam material with an outer custom sculpted surface. In the case of a caricature head, the facial area has features resembling a human head but can be substantially larger in size than a human head. A painted layer is applied to the outer surface of the foam for coloring one or more of the facial features of the foam body. A thin sealing layer coats the foam at least in the facial area to seal the foam but being sufficiently thin that the texture of the foam can be felt, thus resembling a skin like feeling. By using this relatively thin layer, the skin-like texture of the apparatus is preserved while still providing a protective outer layer that can be squeezed and which bounces back due to the memory of the foam. The cutting thus provides a durable coating for the foam yet which does not sink sufficiently into the foam that the foam becomes overweight and unyielding. The larger body costumes are too heavy if coated like the heads. So, rather than being painted, they are sealed with a sealer to prevent absorption of the rubber-like coating. Then the rubber-like coating is applied in the color of choice (example yellow for lemonade).

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

FIGS. 1–6 illustrates the preferred embodiment of the apparatus of the present invention and the method of manufacturing the same. The apparatus of the present invention is designated generally by the numeral 10. In FIGS. 1–4, there is schematically illustrated the method of forming the caricature like heads which characterize the present invention.

Figure 1:
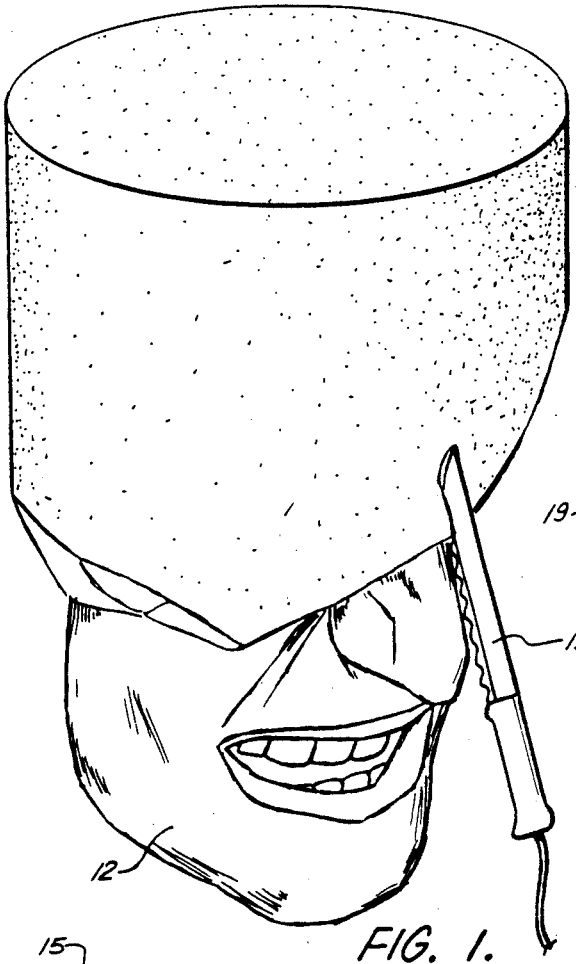
FIG. 1 is a perspective view illustrating the first step of the method of the present invention.
Figure 2:
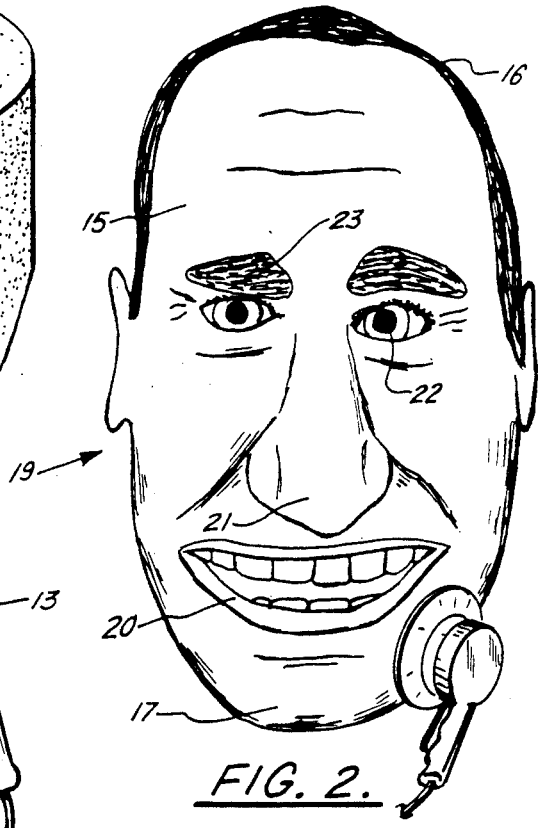
FIG. 2 is a perspective view illustrating the custom sanding/smoothing custom step of the present invention.

In FIG. 1, there can be seen a generally cylindrical precut starting block of foam 12 which is cut to the form of the outline of a human head such as to the form shown in FIG. 2. The user preferably uses a cutting blade such as a electric cutting knife 13. The cutting can be for example manually done by means of an artist (not shown) holding the knife. Sanding (FIG. 2) is used to remove sharp edges formed by the knife.

In FIG. 2 the finished sculpture is sanded. The sculpted head portion 15 is formed from the block of foam and includes an upper 16 and a lower 17 end portion. The foam block 15 has a facial area 19 which includes a plurality of facial features including lips 20, nose 21, eyes 22, forehead 23, eyebrows 24, and cheeks 25.

Figure 3:
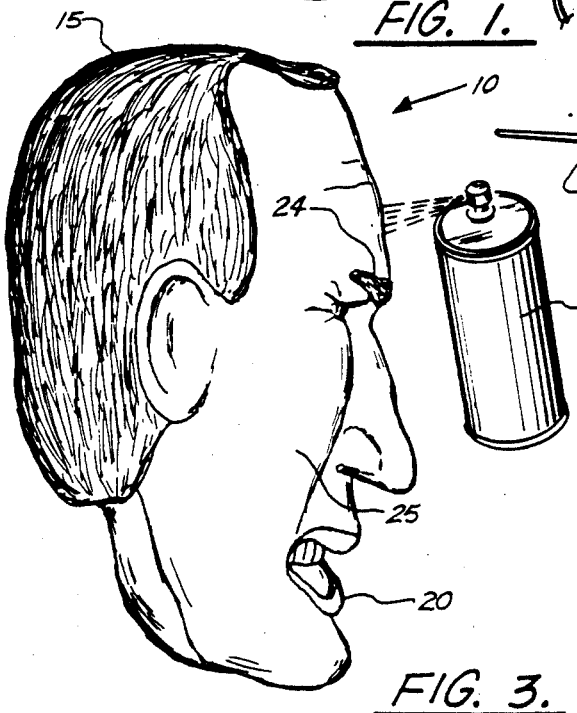
FIG. 3 is a perspective view illustrating the painting step of the present invention.

In FIG. 3, there is schematically illustrated a painting step which shows paint being applied to various facial regions such as the cheek regions. Paint would be applied to any number of desired facial regions including the teeth, lips, eyebrows, hair, and so forth.

Figure 4:
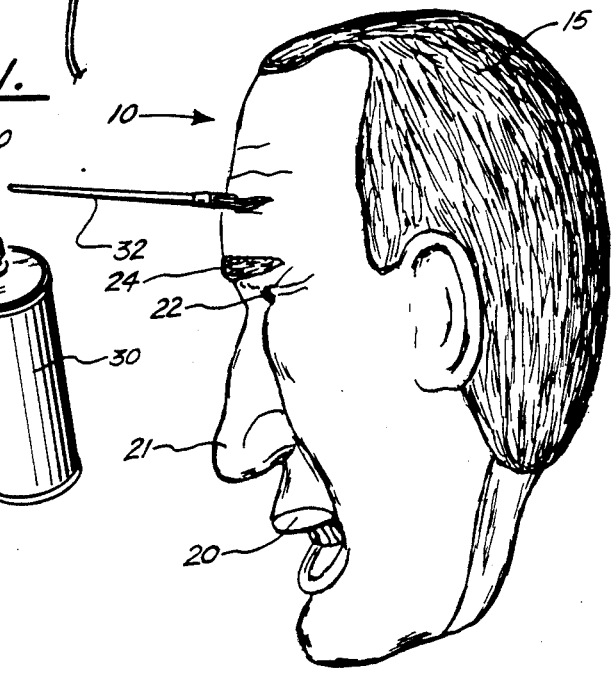
FIG. 4 illustrates the preferred embodiment of the apparatus of the present invention during the last method step of coating of the apparatus with a rubber-like material.

IN FIG. 4, the eyebrows for example could be brown, the eyes blue with a white background, the cheeks shaded with a pinkish color, the lips being pinkish while the teeth would be white and the hair brown as is the case with the eyebrows.

After the painting has been completed by spraying using painting device 30, the entire sculpted foam body 15 is covered with a relatively thin layer of rubber-like liquid plastic material such as "plastidip". The layer is relatively thin being on the order of a few milimeters in thickness. By applying a very thin layer of the liquid rubber sealer using brush 32 for example, the outer surface of the body is sealed yet some of the texture of the foam is retained so that the outer surface of the facial area has a human skin-like feeling. Further, the thin layer allows the foam to give or to slightly deform when squeezed. After being squeezed the memory of the foam then returns the foam body to its original position and shape.

Figure 5:
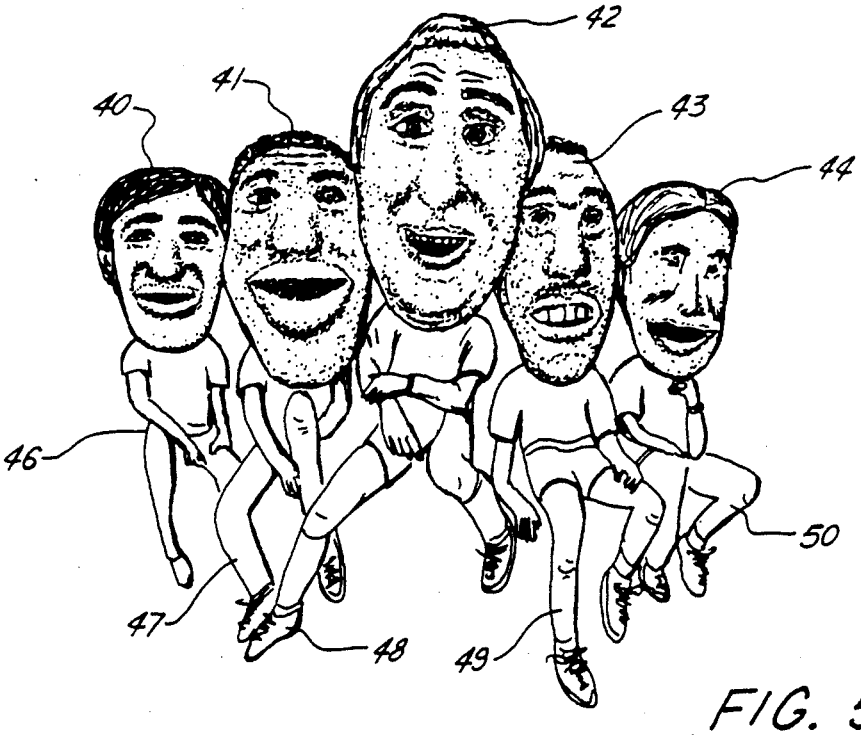
FIG. 5 is a perspective view illustrating the preferred embodiment of the apparatus of the present invention in the form of a group of caricature heads representing members of a professional basketball team.
Figure 6:
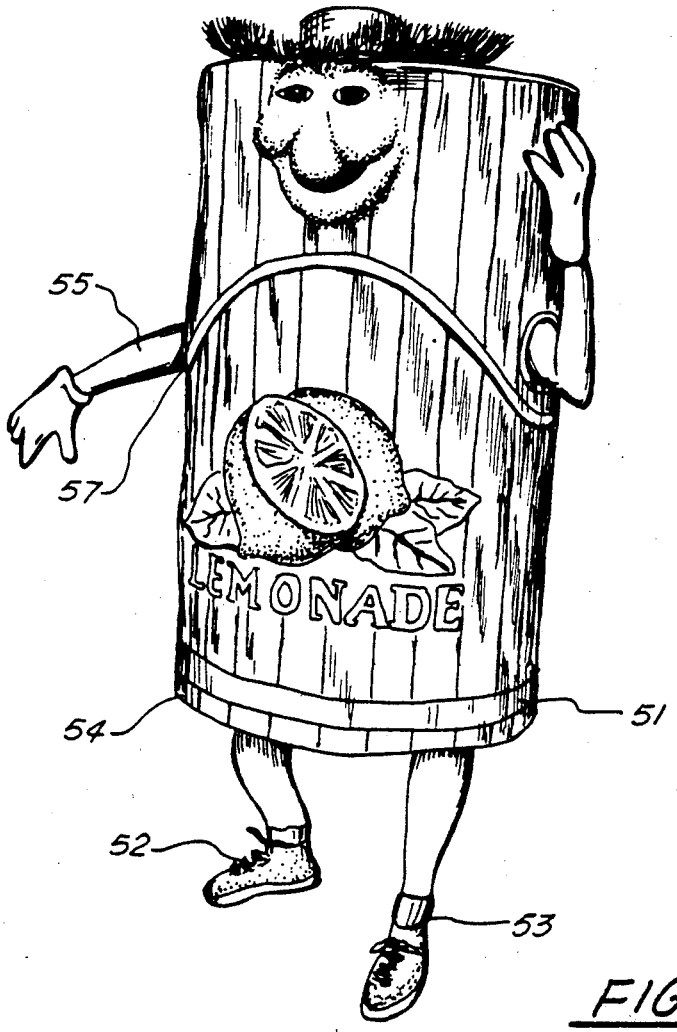
FIG. 6 is a perspective view of another embodiment of the apparatus of the present invention in the form of a lemonade can costume.

In FIG. 5, caricature heads 40–45 are shown as costumes worn by individuals 46–50 to represent a well-known basketball team, the Boston Celtics. In FIG. 6, a lemonade can 51 is formed according to the present invention with the wearers legs 52, 53 protruding from the lower end portion 54, and the wearers arms 55, 56 protruding from openings 57, 58. The caricature heads are coated after the painting step with a flexible rubber coating such as "plastidip", which is a commercially available heavy duty flexible rubber coating material. U.S. Pat. No. 4,536,454 also describes such a coating material.

When forming a costume body such as the lemonade can 51 of FIG. 6, the body is first sculpted, then sanded as with the caricature head of FIGS. 1–4. However, the body 51 is then sealed to prevent absorption using a sealer such as "J-Spray" (PDC-11), a commercially available sealer. A second layer of colored plastidip is used to color the body. The can body 51 is smooth while the caricature heads can have a textured skin-like feel.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An enlarged life-like human costume head comprising:

(a) a body of foam material having an outer sculpted surface formed by cutting with at least a facial surface area with features resembling a human head, the body being substantially larger in size than a human head so that it can be worn by an individual user;

(b) a painted layer applied to the outer sculpted surface of the foam for coloring one or more facial features of the facial surface area with multiple contrasting colors; and (c) a thin sealing layer that coats the foam body at least in the facial surface area to seal the foam but being sufficiently thin that the texture of the foam can be felt, resembling a skin-like feeling.

2. The costume head of FIG. 1 wherein the thin sealing layer is a rubber-like material.

3. The costume head of claim 1 wherein the painted layer includes multiple colors applied to different respective facial surface areas including at least eyes, skin and lips.

4. The costume head of claim 3 wherein the outer sculpted surface includes at least lips, nose, eyes, and eyebrows.

5. The costume head of claim 2 wherein the thin sealing layer is a flexible rubber-like coating.

* * * * *